US006012389A

United States Patent [19]

Roskosch et al.

[11] Patent Number: 6,012,389

[45] Date of Patent: Jan. 11, 2000

[54] INK FOUNTAIN FOR ROTARY OFFSET PRINTING PRESSES

[75] Inventors: Bernhard Roskosch, Wiesloch; Michael Voge, Malsch, both of Germany

[73] Assignee: Heidelberger Druckmaschinen Aktiengesellschaft, Heidelberg, Germany

[21] Appl. No.: 08/979,374

[22] Filed: Nov. 26, 1997

[30] Foreign Application Priority Data

Nov. 28, 1996 [DE] Germany ..... 196 49 318

[51] Int. Cl.[7] ..... B41F 31/05; B41F 31/06

[52] U.S. Cl. ..... 101/365

[58] Field of Search ..... 101/365, 363, 101/366, 157, 169, 350.1, 350.6

[56] References Cited

U.S. PATENT DOCUMENTS 4,242,958 1/1981 Jeschke .

4,387,648 6/1983 Jeschke et al. ..... 101/365

4,596,187 6/1986 Rüger .

FOREIGN PATENT DOCUMENTS 0131106 1/1985 European Pat. Off. .

2648098 5/1978 Germany .

2923678 12/1980 Germany .

*Primary Examiner*—J. Reed Fisher

*Attorney, Agent, or Firm*—Nils H. Ljungman and Associates

[57] ABSTRACT

An ink fountain for rotary offset printing presses with an ink dosing device which includes of a plurality of zone-width dosing elements located next to one another in close proximity. The dosing elements have support and dosing areas, and the support areas are in constant direct or indirect contact under spring pressure with an ink fountain roller. The dosing areas can be adjusted to different ink gap thicknesses by rotating the dosing elements. The hydrodynamic forces or the spring pressure on the dosing elements can therefore be reduced.

13 Claims, 2 Drawing Sheets

INK FOUNTAIN FOR ROTARY OFFSET PRINTING PRESSES

BACKGROUND OF THE INVENTION

1. Field of the Invention

The present invention relates to an ink fountain for rotary offset printing units with an ink dosing device which includes a plurality of zone-width dosing elements located next to one another in close proximity. The dosing elements have support and dosing areas, the support areas of which are in constant direct or indirect contact under spring pressure with an ink fountain roller. The dosing areas can be adjusted to different ink gap thicknesses by rotating the dosing elements.

2. Background Information

U.S. Pat. No. 4,387,648, which corresponds to German Patent No. 29 23 678 C2, discloses a similar configuration of an ink fountain, the purpose of which is to prevent the origin of uninked strips on the ink fountain roller as a result of the continuous contact of the support areas. For this purpose, corresponding to each dosing element there is a dosing blade which extends over the length of the dosing element. The purpose of this dosing blade is to spread the ink out axially toward or after the dosing area, so that the ink is distributed evenly over the entire width of the zone. In this known solution, the dosing elements are under a constant spring pressure which, during the operation of the press, i.e. during the rotation of the ink fountain roller, can result in wear and abrasion of the film which covers the dosing elements. In this case, the spring pressure must be designed so that it overcomes the hydrodynamic pressure caused by the rotational movement of the ink fountain roller and guarantees a secure direct or indirect contact between the dosing elements and the cylindrical surface of the ink fountain roller.

OBJECT OF THE INVENTION

On the basis of this realization of known devices, the object of the present invention is to reduce the hydrodynamic forces or the spring pressure on the dosing elements, and thus to reduce wear and abrasion and the generation of beat.

SUMMARY OF THE INVENTION

The present invention teaches that this object can be accomplished by using dosing elements which, beginning in the vicinity of the ink gap thickness 0, have a flat portion which runs in the form of a secant and forms a wiper edge in the vicinity of the ink gap thickness 0. As a result of this wiper edge, the hydrodynamic pressure which occurs is significantly less or lessened and the corresponding spring pressure required can be reduced. Wear phenomena on the film can thereby be reduced, and at the same time there is a significantly reduced development of heat in the vicinity of the ink.

In one advantageous embodiment of the present invention, the flattened area extends over the length of the dosing area. As a result, the hydrodynamic pressure is not increased when a dosing element is in the zero or idle or rest position.

An additional advantageous embodiment of the present invention is characterized by the fact that the support areas which are in direct or indirect contact with the ink fountain roller can have a radius of approximately 3 mm. As a result of this small radius, the wedge effect between the dosing element and the cylindrical surface of the ink fountain roller is reduced, so that the hydropneumatic pressure can simultaneously be reduced. Here, again, the spring pressure and thus the wear on the film can be reduced.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintain that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below, with reference to the embodiment illustrated in the accompanying drawings, wherein.

DESCRIPTION OF THE PREFERRED EMBODIMENT

Figure 1:
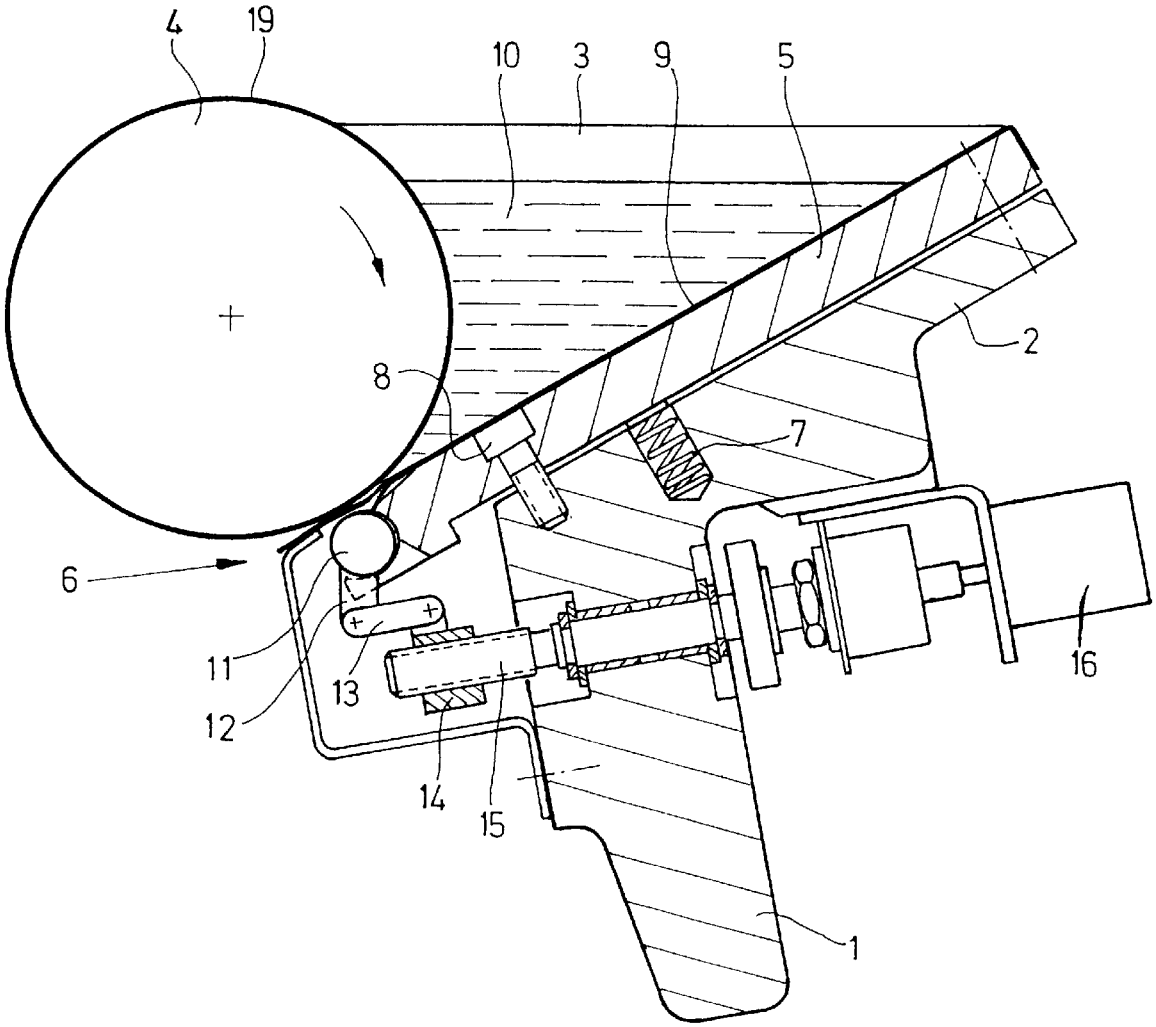
FIG. 1 is a cross section through an ink fountain with an ink fountain roller.

The ink fountain 1 illustrated in FIG. 1 includes a base plate 2 and side walls 3 which enclose the ink chamber on the ends. The ink fountain 1 has an ink fountain roller 4, which ink fountain roller 4 transports the required quantity of ink to an inking mechanism of a rotary offset printing press. Above the base plate 2, there are pressure pads or plates 5 next to one another, on which pressure pads 5 there is an ink dosing device 6. The pressure pads 5 and the ink dosing device 6 are located next to one another in close proximity over the length of the ink fountain 1. The pressure pads 5 are thereby supported on compression springs 7 and are held loosely by screws 8. The pressure pads 5 and the ink dosing device 6 are covered by a film 9 which prevents contamination by the printing ink 10.

The ink dosing device 6 includes a plurality of zone-width dosing elements 11 located next to one another in close proximity, each of which dosing elements 11 can be pivoted by means of an actuator arm 12, a connecting rod 13 and an adjusting nut 14. The adjusting nut 14 can be moved in the longitudinal direction by a set or adjustment screw 15, whereby the set screw 15 is driven by an actuator or servo motor 16.

Figure 2:
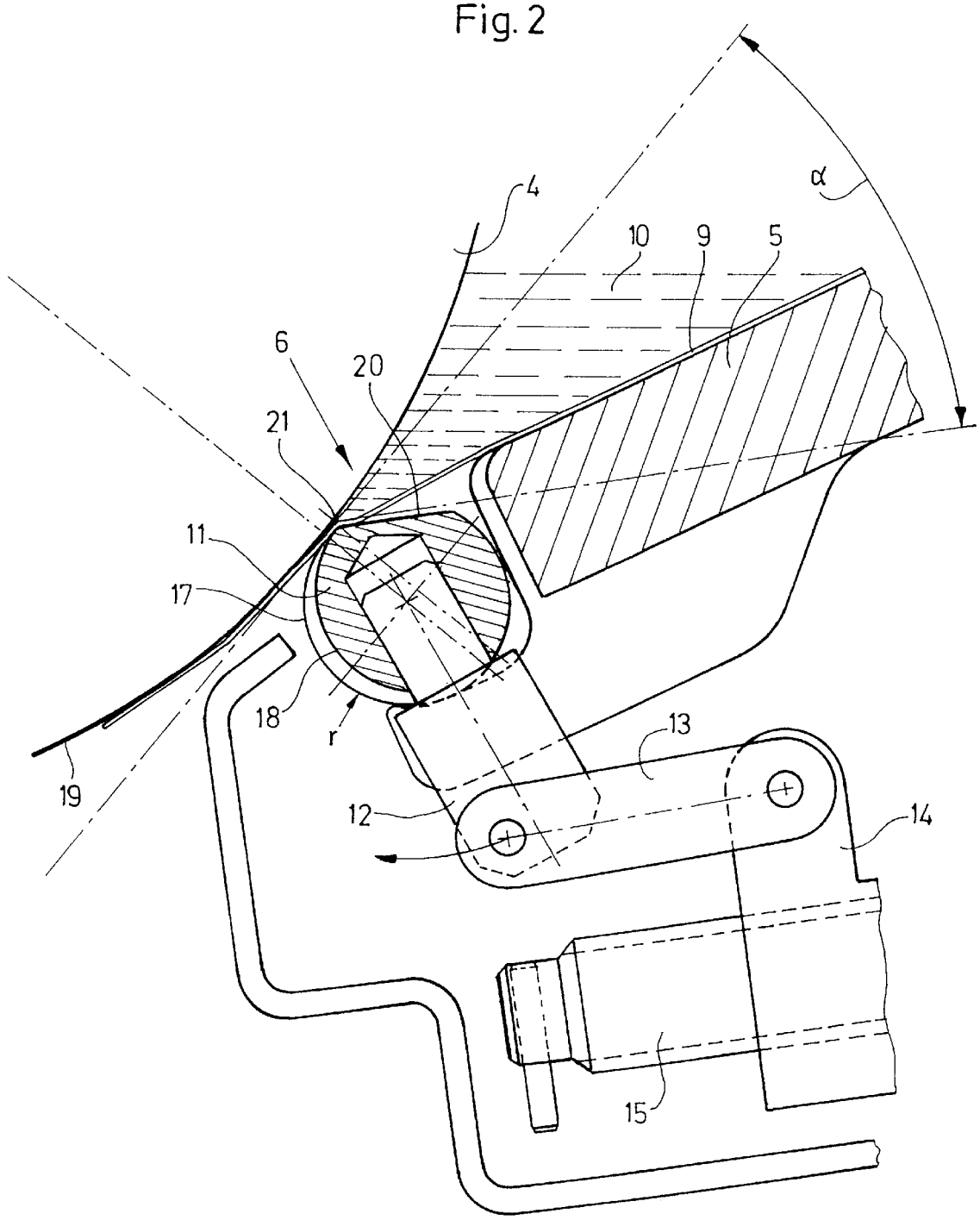
FIG. 2 shows an enlarged detail of the ink dosing device.

In one embodiment, each dosing element 11 has two narrow support areas 17, e.g. on its periphery, between which there is a dosing area 18 which runs eccentrically. By rotating the dosing element 11 in the clockwise direction as illustrated in FIG. 2, there is a gap which becomes wider between the support area 17 and the dosing area 18, into which gap the elastic film 9 is inserted, so that when the ink fountain roller 4 is rotated, an ink strip of a corresponding thickness and width is formed on its cylindrical surface 19. By means of this ink gap thickness, it is thereby possible to adjust the quantity of ink to be transported into an inking mechanism for each zone.

In the embodiment illustrated in FIG. 2, the dosing element 11 is shown in its zero position, i.e. the support area 17 and the dosing area 18 are on one level, so that there is no ink gap. In this position, the hydrodynamic pressure of the ink 10 is the greatest. The present invention teaches that in this area, a flattening 20 is provided which runs in the form of a secant at a specified angle . The result is the formation on the dosing element 11, in the vicinity of the ink gap thickness 0, of a wiper edge 21, over which wiper edge 21 the elastic film 9 is applied or placed or laid. The wiper edge 21 removes all the ink from the cylindrical surface 19 of the ink fountain roller 4, without the formation of a high dynamic pressure of the printing ink 10. It therefore becomes possible to design the compression spring 7 in a corresponding manner so that the spring pressure on the dosing element 11 and thus against the cylindrical surface 19 of the ink fountain roller 4 is reduced.

In one variant embodiment, the flattening 20 can extend over the length of the dosing area 18, so that the support areas 17 can be realized in a circular shape. It is also possible to reduce the dynamic pressure of the printing ink 10 by realizing the dosing element 11 so that the support areas 17 in direct or indirect contact against the ink fountain roller 4 have a radius r of approximately 3 mm. This measure can also be used to reduce the dynamic angle or accumulation angle for the printing ink 10, so that the application pressure on the cylindrical surface 19 of the ink fountain roller 4 is reduced, and the wear of the film 9 or the amount of heat generated can be reduced.

One feature of the invention resides broadly in the ink fountain for rotary offset printing presses with an ink dosing device which consists of a plurality of zone-width dosing elements located next to one another in close proximity, which dosing elements have support and dosing areas, and the support areas of which are in constant direct or indirect contact under spring pressure with an ink fountain roller, whereby the dosing areas can be adjusted to different ink gap thicknesses by rotating the dosing elements, characterized by the fact that the dosing elements 11, beginning in the vicinity of the ink gap thickness 0, have a flattening 20, which runs in the form of a secant, and forms a wiper edge in the vicinity of the ink gap thickness 0.

Another feature of the invention resides broadly in the ink fountain characterized by the fact that the flattening 20 extends over the length of the dosing area 18.

Yet another feature of the invention resides broadly in the ink fountain characterized by the fact that the support areas 17 which are in direct or indirect contact with the ink fountain roller 4 have a radius r of approximately 3 mm.

The appended drawings in their entirety, including all dimensions, proportions and/or shapes in at least one embodiment of the invention, are accurate and to scale and are hereby included by reference into this specification.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. An ink fountain for a rotary offset printing press comprising:

an ink dosing device;

an ink fountain roller disposed adjacent to said ink dosing device;

an ink supply disposed to provide ink to said ink dosing device;

said ink dosing device comprising at least one dosing element;

said at least one dosing element comprising a substantially flat portion and a substantially rounded portion;

said ink dosing device having a portion immediately adjacent said ink fountain roller;

said substantially flat portion of said at least one dosing element being disposed upstream of said portion of said ink dosing device immediately adjacent said ink fountain roller;

said substantially flat portion being configured to be disposed adjacent the flow of ink from said ink supply to said ink fountain roller;

a wiper edge being disposed at a conjunction of said substantially flat portion and said substantially rounded portion;

said wiper edge being disposed substantially adjacent said ink fountain roller;

said ink fountain being configured to permit ink to flow substantially adjacent said ink fountain roller from a side upstream of said wiper edge to a side downstream of said wiper edge;

a section of said rounded portion of said at least one dosing element defining a tangent substantially at said wiper edge;

a section of said substantially flat portion substantially adjacent said wiper edge lying on a secant of said rounded portion; and said secant being disposed to form an acute angle with respect to the tangent, the acute angle being disposed substantially on the upstream side of said edge and substantially between said ink fountain roller and said at least one dosing element.

2. The ink fountain according to claim 1 wherein:

said at least one dosing element comprises a plurality of dosing elements; and each of said plurality of dosing elements comprises a wiper edge.

3. The ink fountain according to claim 2 comprising:

a film; and said film being disposed between said ink supply and said ink dosing device.

4. The ink fountain according to claim 3 wherein:

each of said plurality of dosing elements comprises:

at least one support area; and at least one dosing area;

said film comprises a portion;

said portion of said film is disposed adjacent said ink fountain roller; and said at least one support area of each of said plurality of dosing elements is disposed in contact with said portion of said film disposed adjacent said ink fountain roller.

5. The ink fountain according to claim 4 wherein:

each of said plurality of dosing elements has a longitudinal axis;

said at least one dosing area of each of said plurality of dosing elements has a length in the axial direction; and said wiper edge of each of said plurality of dosing elements extends over the entire length of said at least one dosing area of each of said plurality of dosing elements.

6. The ink fountain according to claim 5 wherein:

said at least one support area of each of said plurality of dosing elements has a radius substantially transverse to the axial direction; and the radius of said at least one support area of each of said plurality of dosing elements is approximately 3 millimeters.

7. The ink fountain according to claim 6 comprising:

a base plate disposed to support said ink supply;

a pressure plate disposed against said base plate;

said film being disposed adjacent said pressure plate;

at least one screw to connect said pressure plate and said base plate;

at least one compression spring disposed between said base plate and said pressure plate to bias said pressure plate against said ink fountain roller; and a drive mechanism to drive said plurality of dosing elements.

8. An ink fountain for a rotary offset printing press comprising:

an ink dosing device;

said ink dosing device being configured to be disposed adjacent an ink fountain roller;

said ink dosing device being configured to support a protective film which protective film is configured to contain ink in said ink fountain which ink is to be contained between the protective film and an ink fountain roller;

said ink dosing device comprising at least one dosing element;

said at least one dosing element having an outer surface and an axis of rotation;

said outer surface of said at least one dosing element comprising a first portion and a second portion;

an edge being disposed at a conjunction of said first portion and said second portion;

said edge being configured to be disposed substantially adjacent an ink fountain roller;

said second portion comprising a substantially rounded portion;

said ink fountain being configured to permit ink to flow from a side upstream of said edge to a side downstream of said edge;

a part of said first portion substantially adjacent said edge being configured to gradually recede from said edge substantially continuously toward said axis of rotation and being configured to support the protective film a distance from said edge sufficient to minimize hydropneumatic pressure on the protective film and to thus minimize wear of the protective film.

9. The ink fountain according to claim 8 wherein:

said substantially rounded portion defines a tangent to said substantially rounded portion substantially adjacent said edge;

said first portion comprises a first part and a second part;

said first part is disposed substantially adjacent said edge;

said second part is disposed adjacent a side of said first part opposite said edge;

said first part lies on a secant of said substantially rounded portion;

said secant is disposed to form an acute angle with respect to the tangent, the acute angle being disposed on the upstream side of said edge;

said first part substantially adjacent said edge recedes from said edge toward the axis of rotation and is configured to support the protective film for a substantial distance from said edge and to minimize hydropneumatic pressure on the protective film and to thus minimize wear of the protective film.

10. The ink fountain according to claim 9 wherein:

said at least one dosing element comprises a plurality of dosing elements; and each of said plurality of dosing elements comprises an edge.

11. The ink fountain according to claim 10 comprising:

each of said plurality of dosing elements has an axis of rotation;

each of said plurality of dosing elements having at least one dosing area;

said at least one dosing area of each of said plurality of dosing elements has a length in the axial direction; and said edge of each of said plurality of dosing elements extends over substantially the entire length of said at least one dosing area of each of said plurality of dosing elements.

12. An ink fountain for a rotary offset printing press comprising:

an ink dosing device;

said ink dosing device being configured to be disposed adjacent an ink fountain roller;

said ink dosing device being configured to support a protective film which protective film is configured to contain ink in said ink fountain which ink is to be contained between the protective film and an ink fountain roller;

said ink dosing device comprising at least one dosing element;

said at least one dosing element having an outer surface and an axis of rotation;

said outer surface of said at least one dosing element comprising a first portion and a second portion;

an edge being disposed at a conjunction of said first portion and said second portion;

said edge being configured to be disposed substantially adjacent an ink fountain roller;

said second portion comprising a substantially rounded portion;

said substantially rounded portion defining a tangent to said substantially rounded portion substantially adjacent said edge;

said ink fountain being configured to permit ink to flow from a side upstream of said edge to a side downstream of said edge;

said first portion comprising a first part and a second part;

said first part being disposed substantially adjacent said edge;

said second part being disposed adjacent a side of said first part opposite said edge;

said first part lying on a secant of said substantially rounded portion;

said secant being disposed to form an acute angle with respect to the tangent, the acute angle being disposed on the upstream side of said edge;

said first part substantially adjacent said edge receding from said edge toward said axis of rotation and being configured to support the protective film for a substantial distance from said edge and to minimize hydropneumatic pressure on the protective film and to thus minimize wear of the protective film.

13. The ink fountain according to claim 12 wherein:

said edge comprises a wiper edge;

said at least one dosing elements comprises a plurality of dosing elements;

each of said plurality of dosing elements comprises a wiper edge;

each of said plurality of dosing elements has a dosing area;

each of said dosing areas has a length in the axial direction; and the length of said dosing area extends over substantially all of the length of said dosing element.

* * * * *

UNITED STATES PATENT AND TRADEMARK OFFICE

CERTIFICATE OF CORRECTION

PATENT NO. : 6,012,389

DATED : January 11, 2000

INVENTOR(S) : Bernhard ROSKOSCH and Dr. Michael VOGE

It is certified that error appears in the above-indentified patent and that said Letters Patent is hereby corrected as shown below:

In column 3, line 5, after 'angle', delete "." and insert --α--.

Signed and Sealed this

Tenth Day of April, 2001

*Attest:*

Nicholas P. Godici

NICHOLAS P. GODICI

*Attesting Officer*

*Acting Director of the United States Patent and Trademark Office*